US006508073B2

(12) United States Patent
Noro et al.

(10) Patent No.: US 6,508,073 B2
(45) Date of Patent: Jan. 21, 2003

(54) HOT WATER SUPPLY SYSTEM WITH HEAT PUMP CYCLE

(75) Inventors: Shinya Noro, Kariya (JP); Hisayoshi Sakakibara, Nishio (JP); Tomoaki Kobayakawa, Tokyo (JP); Kazutoshi Kusakari, Urawa (JP); Michiyuki Saikawa, Zushi (JP)

(73) Assignees: DENSO Corporation, Kariya (JP); Tokyo Electric Power Company, Tokyo (JP); Central Research Institute of Electric Power Industry, Tokyo (JP)

( * ) Notice: Subject to any disclaimer, the term of this patent is extended or adjusted under 35 U.S.C. 154(b) by 0 days.

(21) Appl. No.: 09/836,991

(22) Filed: Apr. 18, 2001

(65) Prior Publication Data

US 2001/0045102 A1 Nov. 29, 2001

(30) Foreign Application Priority Data

Apr. 19, 2000 (JP) ..... 2000-117577

(51) Int. Cl.[7] ..... F25B 27/00
(52) U.S. Cl. ..... 62/238.6
(58) Field of Search ..... 62/238.6, 84, 473

(56) References Cited

U.S. PATENT DOCUMENTS

| | | | | |
|---|---|---|---|---|
| 4,406,137 A | | 9/1983 | Demuth et al. | |
| 4,487,032 A | | 12/1984 | Speicher | |
| 4,766,734 A | * | 8/1988 | Dudley | 62/160 |
| 5,419,155 A | | 5/1995 | Boehde et al. | |
| 5,462,113 A | | 10/1995 | Wand | |
| 6,263,683 B1 | * | 7/2001 | Tazaki | 62/114 |

FOREIGN PATENT DOCUMENTS

| | | |
|---|---|---|
| DE | 37 05 850 | 9/1988 |
| DE | 199 55 339 | 5/2000 |
| JP | U58-28260 | 8/1956 |
| JP | A60-250 | 1/1985 |
| JP | A62-108970 | 5/1987 |
| JP | A1-193561 | 8/1989 |
| JP | A3-84359 | 4/1991 |
| JP | U6-73652 | 10/1994 |
| JP | A9-236316 | 9/1997 |
| JP | A9-264632 | 10/1997 |
| JP | A10-288411 | 10/1998 |
| WO | WO 84/02386 | 6/1984 |

* cited by examiner

*Primary Examiner*—William C. Doerrler
*Assistant Examiner*—Malik N. Drake
(74) *Attorney, Agent, or Firm*—Harness, Dickey & Pierce, PLC

(57) ABSTRACT

In a hot water supply system with a heat pump cycle, an oil separator for separating refrigerant and oil flowing from a compressor from each other is provided, and oil separated from refrigerant in the oil separator returns to the compressor through an oil returning passage after passing through an oil passage of a water heat exchanger. The water heat exchanger includes a first heat exchanging portion in which refrigerant from the oil separator and water from a tank are heat-exchanged, and a second heat exchanging portion in which oil from the oil separator and water from the tank are heat-exchanged. In the heat exchanger, a flow direction of water is set opposite to that of refrigerant and oil.

11 Claims, 3 Drawing Sheets

HOT WATER SUPPLY SYSTEM WITH HEAT PUMP CYCLE

CROSS-REFERENCE TO RELATED APPLICATION

This application is related to Japanese Patent Application No. 2000-117577 filed on Apr. 19, 2000, the contents of which are hereby incorporated by reference.

BACKGROUND OF THE INVENTION

1. Field of the Invention

The present invention relates to a hot water supply system with a heat pump cycle, in which hot water heated by the heat pump cycle is stored in a water tank to be used.

2. Description of Related Art

In a conventional heat pump cycle used for a hot water supply system, because an oil for lubricating a sliding portion of a compressor is sealed, the oil is mixed in refrigerant circulating in the heat pump cycle, and a cycle efficiency is decreased due to the oil. To overcome this problem, an oil separator for separating oil from refrigerant can be disposed at a refrigerant discharge side of the compressor so that oil separated from refrigerant in the oil separator is returned to the compressor. However, because the oil separated from refrigerant in the oil separator has a high temperature, low-temperature gas refrigerant sucked into the compressor is heated when the high-temperature oil is returned to the compressor.

More particularly, in a super-critical (trans-critical) heat pump cycle where a refrigerant pressure discharged from the compressor becomes more than the critical pressure of refrigerant, a large amount of oil is need, as compared with a general refrigerant cycle using flon as refrigerant. Accordingly, the oil heat greatly affects the super-critical heat pump-cycle.

SUMMARY OF THE INVENTION

In view of the foregoing problems, it is an object of the present invention to provide a hot water supply system with a heat pump cycle, which can improve a cycle efficiency.

According to the present invention, in a hot water supply system, a heat pump cycle includes an oil separator, disposed at a refrigerant discharge side of a compressor, for separating oil and refrigerant discharged from the compressor from each other, and a heat exchanger which is disposed to perform a heat exchange between oil separated in and flowing from the oil separator and water from a tank for storing heated water. Further, oil separated from refrigerant in the oil separator returns to the compressor after passing through the heat exchanger. Therefore, water is heated in the heat exchanger by high-temperature oil from the oil separator, and oil returning to the compressor is cooled by water, in the heat exchanger. Accordingly, oil heat can be effectively used for heating water, and a cycle efficiency of the heat pump cycle can be increased.

Preferably, a flow direction of oil is opposite to a flow direction of water in the heat exchanger. Therefore, heat exchanging efficiency between oil and water can be improved in the heat exchanger, and oil heat can be effectively recovered.

Preferably, the heat exchanger includes the first heat exchanging portion and the second heat exchanging portion which are integrally formed to have a refrigerant passage through which refrigerant flows, an oil passage through which oil flows and a water passage through which water flows. Further, the water passage is provided between the refrigerant passage and the oil passage. Accordingly, water can be effectively heat-exchanged with refrigerant and oil, respectively, and heat from refrigerant and oil can be effectively used for heating water.

When high-pressure side refrigerant pressure is equal to or greater than critical pressure of refrigerant in the heat pump cycle, an oil amount sealed in the heat pump cycle becomes larger. Even in this case, because the oil heat can be effectively recovered in the heat exchanger, heat loss can be prevented.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENT

A preferred embodiment of the present invention will be described hereinafter with reference to the accompanying drawings.

Figure 1:
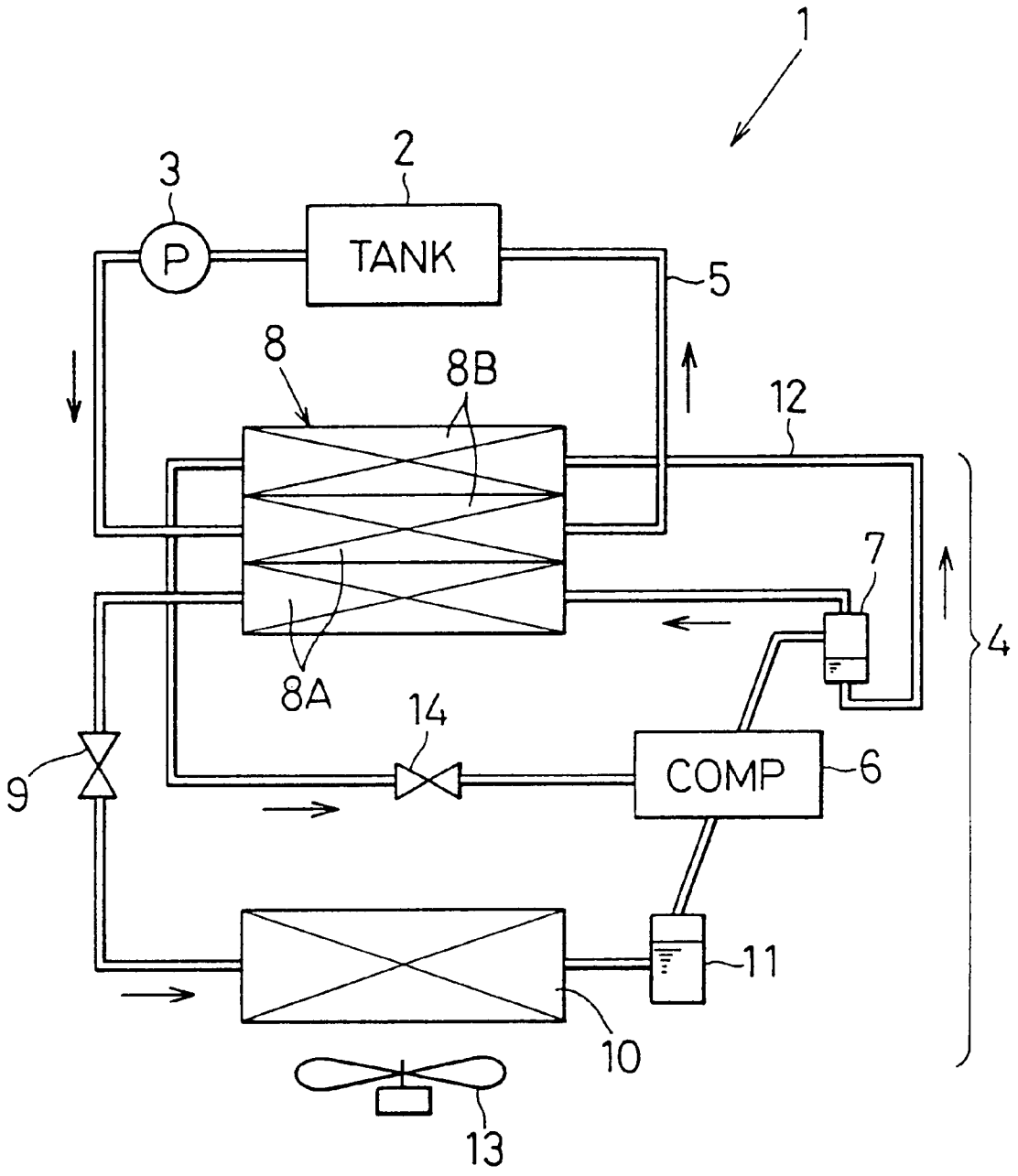
FIG. 1 is a schematic diagram showing a hot water supply system with a heat pump cycle according to a preferred embodiment of the present invention.

As shown in FIG. 1, a heat-pump hot water supply system 1 includes a tank 2 in which heated hot water is stored, an electrical pump 3 forcibly circulating water in a water cycle, and a super-critical heat pump cycle 4 disposed to heat water in the water cycle. Hot water in the tank 2 is supplied to a user after being temperature-adjusted.

The tank 2 is made of a metal having a corrosion resistance, such as a stainless steel, and has a heat insulating structure so that high-temperature hot water can be stored for a long time. Hot water stored in the tank 2 can be supplied to a kitchen, a bath or the like, and can be used as a heating source for a floor heater or a room heater or the like.

The electrical pump 3, the tank 2 and a water heat exchanger 8 of the heater pump cycle 4 are connected by a water pipe 5 to form the water cycle. Therefore, water circulates between the tank 2 and a water heat exchanger 8 (first heat exchanger), and water circulating amount in the water cycle can be adjusted in accordance with a rotation speed of a motor disposed in the electrical pump 3.

The super-critical heat pump cycle 4 uses carbon dioxide as refrigerant, for example, so that a high-pressure side refrigerant pressure becomes equal to or greater than the critical pressure of carbon dioxide. As shown in FIG. 1, the heater pump cycle 4 includes a compressor 6, an oil separator 7, the water heat exchanger 8, an expansion valve 9, an air heat exchanger 10 (second heat exchanger) and an accumulator 11. An oil returning passage 12 is provided so that only oil separated from refrigerant in the oil separator 7 returns to the compressor 6.

The compressor 6 is driven by an electrical motor, for example, and compresses sucked gas refrigerant so that refrigerant discharged from the compressor 6 has the pressure equal to or greater than the critical pressure of refrigerant. The oil separator 7 is disposed between the compressor 6 and the water heat exchanger 8 in the heat pump cycle 4, so that refrigerant and oil, discharged from the compressor 6, are separated from each other in the oil separator 7.

Figure 3A:
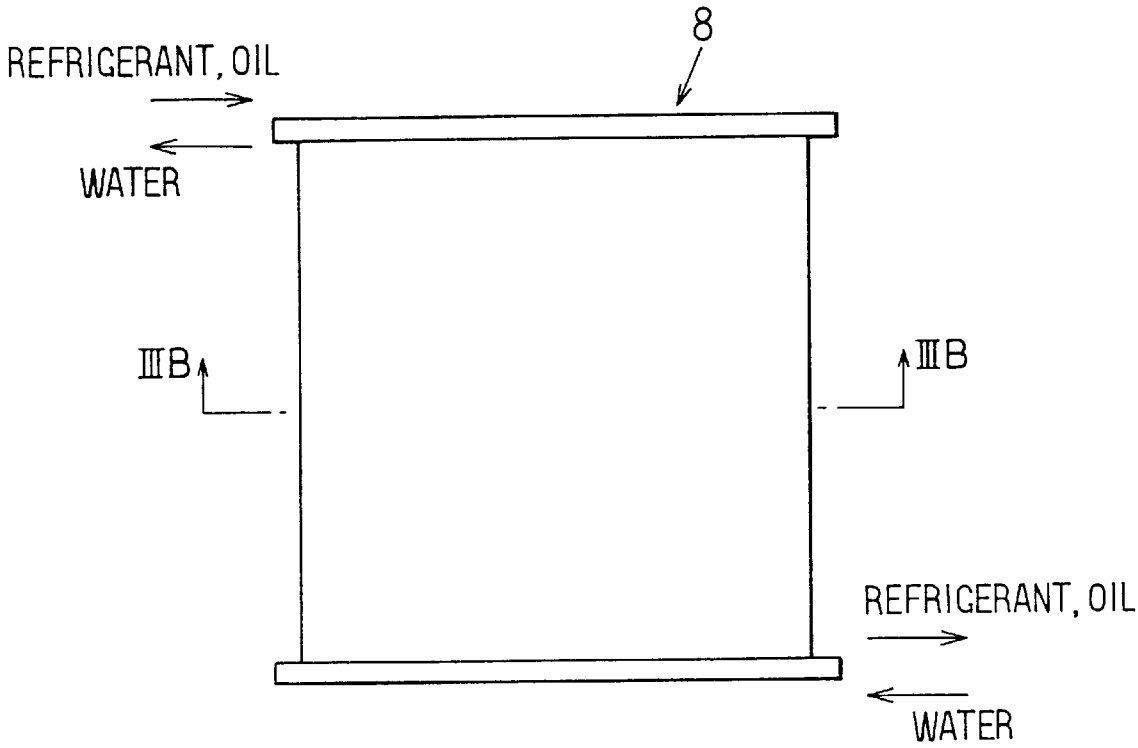
FIG. 3A is a plan view showing a water heat exchanger.
Figure 3B:
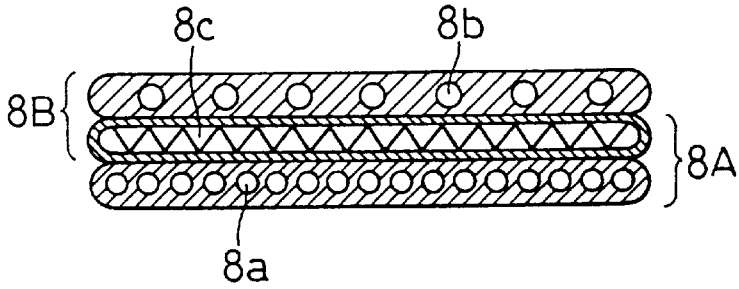
FIG. 3B is a cross-sectional view taken along line IIIB—IIIB in FIG. 3A, according to the embodiment.

The water heat exchanger 8 has a first heat-exchanging portion 8A in which high-temperature high-pressure gas refrigerant from the oil separator 7 is heat-exchanged with water from the tank 2, and a second heat-exchanging portion 8B in which high-temperature oil from the oil separator 7 is heat-exchanged with water from the tank 2. As shown in FIG. 3B, the water heat exchanger 8 has therein a water passage 8*c* provided between a refrigerant passage 8*a* and an oil passage 8*b*. In the water heat exchanger 8, a flowing direction of water in the water passage 8*c* is set opposite to a flowing direction of refrigerant in the refrigerant passage 8*a* and a flowing direction of oil in the oil passage 8*b*.

The expansion valve 9 is constructed so that a valve opening degree can be electrically adjusted. The expansion valve 9 is disposed at a downstream side of the water heat exchanger 8 in a refrigerant flow direction, and decompresses refrigerant cooled in the water heat exchanger 8. A fan 13 for blowing air toward the air heat exchanger 10 is disposed so that refrigerant decompressed in the expansion valve 9 is heat-exchanged with air in the air heat exchanger 10. Therefore, refrigerant is evaporated in the air heat exchanger 10 by absorbing heat from air (i.e., outside air).

Refrigerant from the air heat exchanger 10 flows into the accumulator 11 and is separated into gas refrigerant and liquid refrigerant in the accumulator 11. Only separated gas refrigerant in the accumulator 11 is sucked into the compressor 6, and surplus refrigerant in the heat pump cycle 4 is stored in the accumulator 11.

On the other hand, an upstream side of the oil passage 8*b* of the water heat exchanger 8 is connected to the oil separator 7, and a downstream side of the oil passage 8*b* of the water heat exchanger 8 is connected to the compressor 6, through the oil returning passage 12. Therefore, oil separated and recovered in the oil separator 7 can be returned to the compressor 6 after passing through the oil passage 8*b* of the water heat exchanger 8. A flow adjustment member 14 such as a valve and a throttle is disposed in the oil returning passage 12 to adjust a flow amount of oil returning into the compressor 6. Therefore, the compressor 6 operates normally with a suitable amount oil.

Next, operation of the heat pump cycle 4 according to this embodiment will be now described. High-temperature high-pressure refrigerant compressed in the compressor 6 is cooled by low-temperature water in the water heat exchanger 8 after oil is removed in the oil separator 7. Low-temperature high-pressure refrigerant discharged from the water heat exchanger 8 is decompressed in the expansion valve 9. Thereafter, refrigerant is evaporated in the air heat exchanger 10 by absorbing heat from air, and is sucked into the compressor 6 after passing through the accumulator 11.

On the other hand, oil separated from refrigerant in the oil separator 7 returns to the compressor 6 through the oil returning passage 12 after being heat-exchanged with low-temperature water in the water heat exchanger 8. Therefore, the temperature of oil returned to the compressor 6 can be sufficiently cooled.

Figure 2:
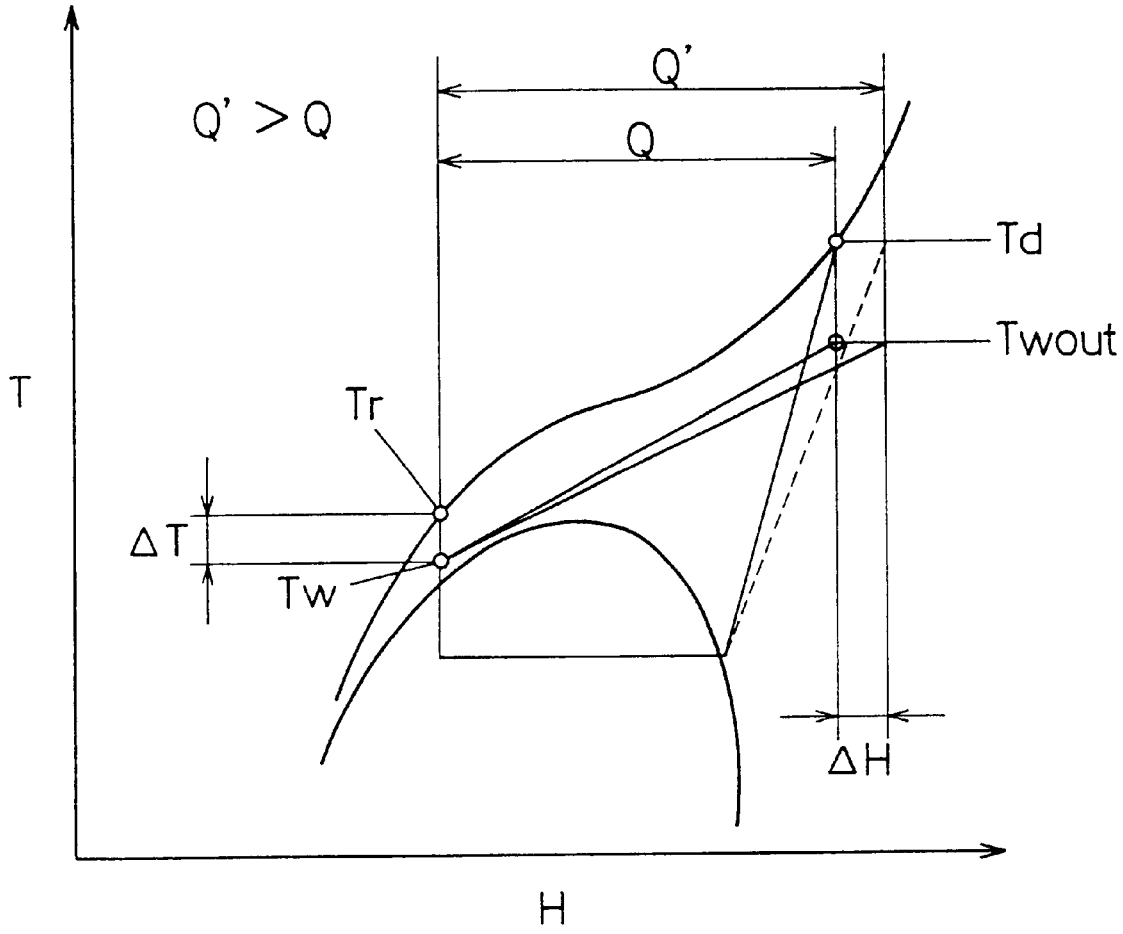
FIG. 2 is a graph (T-H diagram) showing a relationship between temperature and enthalpy in a super-critical heat pump cycle according to the embodiment.

FIG. 2 shows a relationship between temperature and enthalpy. In FIG. 2, Tr indicates temperature of refrigerant flowing out from the water heat exchanger 8, Td indicates temperature of refrigerant discharged from the compressor 6, Tw indicates temperature of water flowing into the water heat exchanger 8, and Twout indicates temperature of water flowing out from the water heat exchanger 8.

According to the embodiment, the heat quantity (i.e., enthalpy difference ΔH in FIG. 2) of oil flowing from the oil separator 7 to the compressor 6 is used for heating low-temperature water in the water heat exchanger 8. Therefore, heat loss in the heat pump cycle 4 can be made smaller, and efficiency of the heat pump cycle 4 is improved. As a result, as shown in FIG. 2, an entire heat-radiating amount in the water heat exchanger 8 can be increased by the heat quantity ΔH (Q→Q') using the heat from oil, and a large heating capacity of water can be obtained while the consumed power can be made smaller.

Although the present invention has been fully described in connection with the preferred embodiment thereof with reference to the accompanying drawings, it is to be noted that various changes and modifications will become apparent to those skilled in the art.

For example, in the above-described embodiment, the super-critical heat pump cycle 4 is used as heating means for heating water. However, even when a general heat pump cycle, where the high-pressure side refrigerant pressure is lower than the critical pressure of refrigerant, is used as the heating means for heating water, the heat of oil can be recovered.

In the above-described embodiment, high-temperature oil separated from refrigerant in the oil separator 7 is cooled by performing a heat exchange with water from the tank 2 in the second heat-exchanging portion 8B of the water heat exchanger 8. However, as a cooling unit for cooling high-temperature oil, the other heat exchanger without using water of the tank 2 may be used. For example, a heat exchanger in which oil separated in the oil separator 7 is heat-exchanged with outside air can be disposed in the oil returning passage 12, so that oil returning into the compressor 6 is cooled.

Such changes and modifications are to be understood as being within the scope of the present invention as defined by the appended claims.

What is claimed is:

1. A hot water supply system comprising:

a heat pump cycle in which refrigerant including oil circulates; and a tank in which water heated by a heat exchange with high-temperature refrigerant of the heat pump cycle is stored, the heat pump cycle includes:

a compressor for compressing and discharging refrigerant, an oil separator, disposed. at a refrigerant discharge side of the compressor, for separating the oil from the refrigerant discharged from the compressor, a heat exchanger which is disposed to perform a heat exchange between the oil separated in and flowing from the oil separator, and the water flowing from the tank, and an oil returning passage through which the oil separated from the refrigerant in the oil separator returns to the compressor after passing through and heat-exchanging with the water in the heat exchanger.

2. The hot water supply system according to claim 1, wherein the heat exchanger is constructed so that a flow direction of oil is opposite to a flow direction of water in the heat exchanger.

3. The hot water supply system according to claim 1, wherein:

the heat exchanger includes a first heat exchanging portion in which the high-temperature refrigerant from the oil separator and water from the tank are heat-exchanged, and a second heat exchanging portion in which oil from the oil separator and water from the tank are heat-exchanged;

the first heat exchanging portion and the second heat exchanging portion are integrally formed to have a refrigerant passage through which refrigerant flows, an oil passage through which oil flows and a water passage through which water flows; and the water passage is provided between the refrigerant passage and the oil passage.

4. The hot water supply system according to claim 3, wherein a flow direction of oil in the oil passage is opposite to a flow direction of water in the water passage.

5. The hot water supply system according to claim 4, wherein a flow direction of refrigerant in the refrigerant passage is opposite to the flow direction of water in the water passage.

6. The hot water supply system according to claim 1, wherein the heat pump cycle includes a flow adjustment member which is disposed in the oil returning passage to adjust a flow amount of oil returning into the compressor.

7. The hot water supply system according to claim 1, wherein a refrigerant pressure discharged from the compressor is equal to or greater than a critical pressure of refrigerant.

8. The hot water supply system according to claim 7, wherein refrigerant in the heat pump cycle is carbon dioxide.

9. A hot water supply system comprising:

a heat pump cycle in which refrigerant circulates; and a tank in which water heated by a heat exchange with high-temperature refrigerant of the heat pump cycle is stored, the heat pump cycle includes a compressor for compressing and discharging refrigerant, an oil separator, disposed at a refrigerant discharge side of the compressor, for separating oil and refrigerant discharged from the compressor from each other, an oil cooler which is disposed to cool oil separated in and flowing from the oil separator, and an oil returning passage through which oil cooled by the oil cooler is returned to the compressor.

10. The hot water supply system according to claim 9, wherein the oil cooler is disposed to perform a heat exchange between oil from the oil separator and air.

11. A hot water supply system comprising:

a water circuit in which water flows, the water circuit including a tank in which heated water is stored;

a compressor for compressing and discharging. refrigerant;

an oil separator, disposed at a refrigerant discharge side of the compressor, for separating oil and refrigerant discharged from the compressor from each other;

a first heat exchanger disposed to perform a heat exchange between water from the tank and refrigerant from the oil separator;

a decompression unit for decompressing refrigerant from the first heat exchanger;

a second heat exchanger disposed to perform a heat exchange between refrigerant from the decompression unit and air; and an oil returning passage through which oil separated from refrigerant in the oil separator returns the compressor, wherein the first heat exchanger has therein an oil passage through which oil flows to perform a heat exchange with water, the oil passage being provided to communicate with the oil returning passage.

* * * * *